US005235706A

United States Patent [19]

Allen et al.

[11] Patent Number: 5,235,706

[45] Date of Patent: Aug. 17, 1993

[54] PROGRAMMABLE URINAL FLUSHING DELAY CIRCUIT

[75] Inventors: Charles S. Allen, Kenilworth; Nhon T. Vuong, Lombard, both of Ill.

[73] Assignee: Sloan Valve Company, Franklin Park, Ill.

[21] Appl. No.: 756,298

[22] Filed: Sep. 6, 1991

[51] Int. Cl.[5] ..... E03D 5/10

[52] U.S. Cl. ..... 4/302; 4/305; 4/313; 4/DIG. 3

[58] Field of Search ..... 4/302, 303, 304, 305, 4/313, 406, DIG. 3

[56] References Cited

U.S. PATENT DOCUMENTS 4,309,781 1/1982 Lissau ..... 4/304
4,667,350 5/1987 Ikenaga et al. ..... 4/304

FOREIGN PATENT DOCUMENTS 0203534 8/1989 Japan ..... 4/313
0203535 8/1989 Japan ..... 4/313
0284628 11/1989 Japan ..... 4/303

*Primary Examiner*—William A. Cuchlinski, Jr.
*Assistant Examiner*—W. Morris Worth
*Attorney, Agent, or Firm*—Kinzer, Plyer, Dorn, McEachran & Jambor

[57] ABSTRACT

An apparatus for controlling flushing of a toilet device detects use of the toilet device and compares the actual number of uses against a preset number of uses which are permitted before flushing of the toilet device. When the actual number of uses equals the predetermined number of uses, the toilet device is flushed. At the first use of the toilet device after flushing, a timing cycle is initiated and the timing cycle will cause flushing of the toilet device unless there is the predetermined number of uses of the device within the period of the timing cycle.

3 Claims, 1 Drawing Sheet

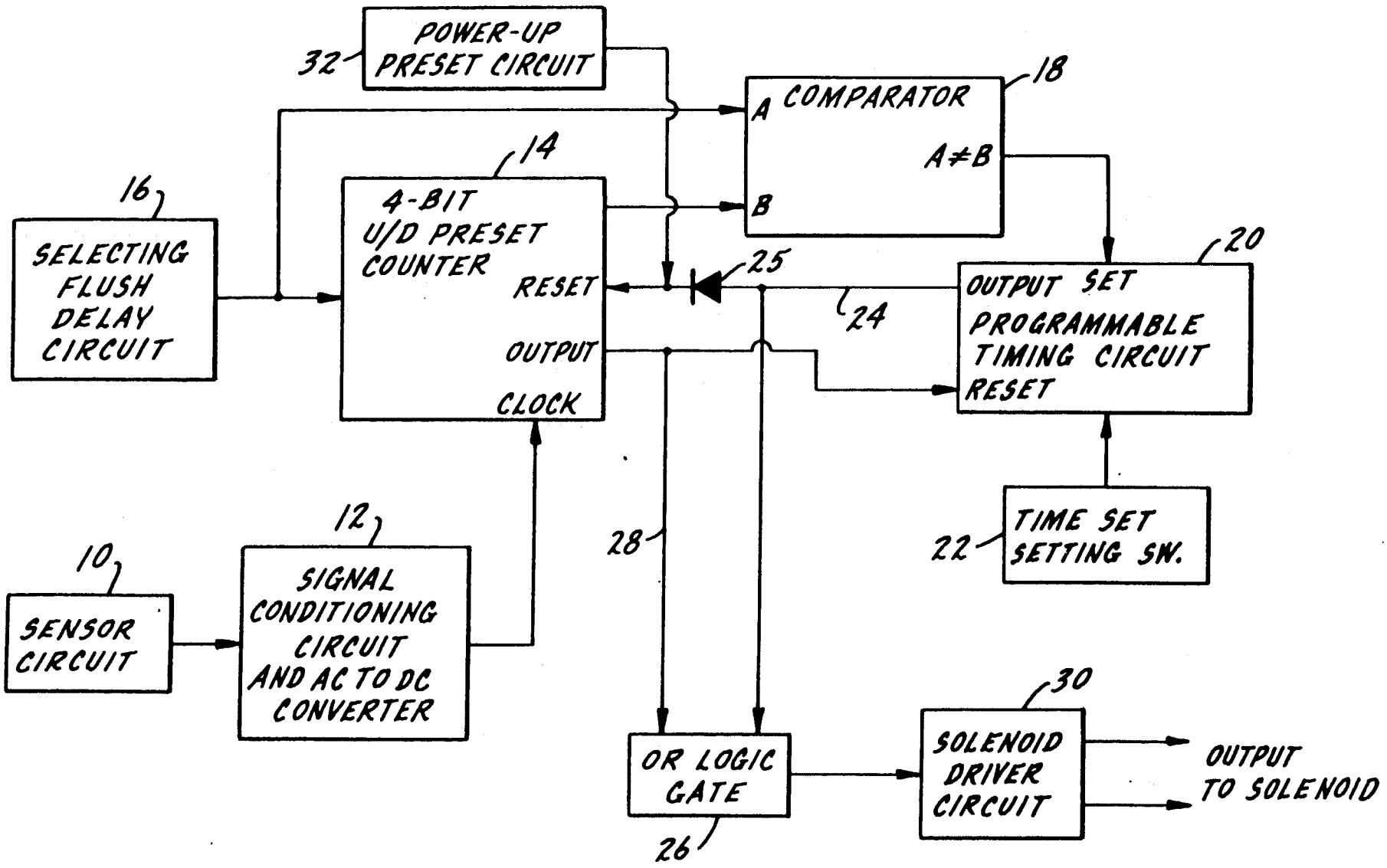
OUTPUT TO SOLENOID
20
OUTPUT SET
PROGRAMMABLE
TIMING CIRCUIT
RESET
TIME SET
SETTING SW.
22
30
SOLENOID
DRIVER
CIRCUIT
18
A COMPARATOR
A≠B
A
B
24
25
OR LOGIC
GATE
26
28
POWER-UP
PRESET CIRCUIT
32
14
4-BIT
U/D PRESET
COUNTER
RESET
OUTPUT
CLOCK
12
SIGNAL
CONDITIONING
CIRCUIT
AND AC TO DC
CONVERTER
16
SELECTING
FLUSH
DELAY
CIRCUIT
10
SENSOR
CIRCUIT

PROGRAMMABLE URINAL FLUSHING DELAY CIRCUIT

THE FIELD OF THE INVENTION

The present invention relates to automatic control circuits for flushing toilet devices such as urinals commonly found in public washrooms. Because of the substantial need to conserve water, it is believed that toilet devices, particularly urinals, need not be flushed after every use, although they should be flushed within a predetermined time period after use. Sloan Valve Company of Franklin Park, Ill., the assignee of the present application, sells an automatic flushing circuit under the trademark "OPTIMA" which detects the use of a urinal and then causes automatic flushing thereof after the user leaves the area of the urinal. The present invention utilizes that detection circuit to register the number of uses of the urinal, and when that number is equal to the permitted number of uses before flushing, the circuit will initiate a flushing cycle. At the first use of the urinal after it has been flushed, a timing cycle is initiated which will effect flushing of the urinal if there has not been the predetermined number of uses thereof during the timing cycle.

SUMMARY OF THE INVENTION

The present invention relates to automatic control circuits for flushing toilet devices such as urinals and in particular to such a control circuit which will initiate flushing of the toilet device either after a predetermined number of uses thereof or within a predetermined time period after the initial use.

A primary purpose of the invention is a control circuit as described which is simple in construction and reliably operable.

Another purpose is a control circuit for the automatic flushing of toilet devices such as urinals which will effect a flushing of the urinal after a predetermined number of uses thereof.

Another purpose of the invention is a control circuit as described which will cause a flushing of the toilet device a predetermined time period after the first use thereof.

Other purposes will appear in the ensuing specification, drawing and claims.

BRIEF DESCRIPTION OF THE DRAWING

The invention is illustrated diagrammatically in the attached schematic diagram of the control circuit described herein.

DESCRIPTION OF THE PREFERRED EMBODIMENT

U.S. Pat. No. 4,309,781 owned by Sloan Valve Company of Franklin Park, Ill., the assignee of the present application, describes a sensor circuit for detecting use of a urinal and causing automatic flushing thereof after the user has left the area. A commercial product utilizing this technology is sold by Sloan Valve Company under the trademark "OPTIMA". The present invention uses the detection circuit of the '781 patent as a means for detecting use of the urinal. The number of uses are counted and when that number equals a preset number, representative of the permitted number of uses of the urinal before required flushing, then the electric operator for flushing the urinal is activated. The first use of the urinal after flushing also starts a timing cycle.

If there has not been the predetermined number of uses of the urinal within the period of the timing cycle, the urinal will be flushed.

In the drawing, the sensor circuit as described in the '781 patent is indicated at 10 and is connected to a signal conditioning circuit and an AC to DC converter 12. The converter 12 will provide an output pulse to the clock input of a counter 14 for every detected use of a toilet device.

Circuit 16 is representative of a means for setting the desired number of uses of a toilet device before it is to be flushed. This may include manual switches or other means in which a preset number can be determined and that number is provided to one input of counter 14. The number representing permitted uses of the urinal before flushing is also provided to a comparator circuit 18 at the input designated A. Comparator 18 also receives a B input which is representative of the actual number of uses of the toilet device as determined from the advancing clock input to counter 14. Counter 14 stores both the preset number of uses and the actual number of uses as indicated by the advancing clock input.

Comparator 18 is connected to a programmable timing circuit 20 which may receive an input from a time set circuit 22. The time set input is indicative of a time period within which the toilet device must be flushed after initial use. Timing circuit 20 has an output on line 24 which is connected to an OR logic gate 26. Output 24 from the timing circuit is also connected, through an isolation diode 25, to the reset input of counter 14. Similarly, counter 14 has an output on line 28 which is connected to another input of OR logic gate 26 with the counter output also being connected to the reset input of timing circuit 20. OR gate 26 is connected to a solenoid driver circuit 30 which will provide an output signal to operate the electric operator to cause flushing of the toilet device, and in the "OPTIMA" system, this is a solenoid. A power-up preset circuit 32 may be used to prevent an undesired flushing operation when the circuit is initially turned on.

In use, the sensor circuit 10 will provide an output signal to converter 12 whenever the toilet device has been used. Each such indication of use provides an input to the clock terminal of counter 14. When the advancing number of uses from the clock signals equals the preset number stored in circuit 14, there is an output from counter 14 on line 28 to OR gate 26. Such an input to the OR gate will cause the solenoid driver 30 to operate the solenoid to flush the urinal.

Comparator 18 has the same preset number as counter 14 and receives an input at terminal B indicative of the number at the clock input of the counter. At the first clock signal to the counter, there is a comparison made at comparator 18 and if the two input numbers thereto are unequal, there will be a signal to the timing circuit 20 to initiate a timing cycle. Once the timing cycle has started, the timing circuit is not responsive to any further outputs from comparator 18. The timing circuit is, however, reset upon an output signal from counter 14 indicative of a signal to cause a flushing of the toilet device. However, if there is no such input to the reset terminal of timing circuit 20 within the time period set by time set circuit 22, the timing circuit will provide an output to OR gate 26 which will cause a flushing of the toilet device.

An output from either the timing circuit or the counter, both of which will effect flushing of the toilet device, has the additional effect of resetting both of these circuits to start a new cycle of operation.

Whereas the preferred form of the invention has been shown and described herein, it should be realized that there may be many modifications, substitutions and alterations thereto.

The embodiments of he invention in which an exclusive property or privilege is claimed are defined as follows:

1. A circuit for controling electric operator flushing of a toilet device including means for detecting use of a toilet device and providing a signal representative thereof, a counter connected to said detecting means for receiving said signals and for accumulating a count thereof representative of a number of detected uses o the toilet device, a comparator connected to said counter to receive a signal therefrom representative o the accumulated count of the number of detected uses of the toilet device, said comparator having a preset number stored therein representative of the number of uses of the toilet device before flushing thereof, said comparator providing an output signal when the detected number of uses of the toilet device is less than the preset number, timing means connected to said comparator to receive the comparator output signal therefrom, which timing means initiates a timing cycle in response to said comparator output signal, an electric operator driving circuit means for sue in flushing a toilet device and connected to said timing means, said timing means providing an operating output signal to said driving circuit means at the end f the timing cycle, said counter having the same preset number stored therein as said comparator, said counter including means therein for comparing the accumulated count of the number of detected uses and said preset number and for providing a counter output signal therefrom when the accumulated count equals said preset number, said counter being connected to said driving circuit means to provide said counter output signal thereto for operating said driving circuit.

2. The circuit of claim 1 further characterized by and including an OR gate having one input connected to the output of said counter and a second input connected to the output of said timing means, said OR gate having an output connected to sa driving circuit whereby a signal from either said counter or said timing means to said OR gate actuates the driving circuit.

3. The circuit of claim 1 further characterized in that the output of said counter is connected to a reset input of said timing means and the output of said timing means is connected to a reset input of said counter.

* * * * *